United States Patent [19]

Fujii et al.

[11] Patent Number: 4,846,630

[45] Date of Patent: Jul. 11, 1989

[54] VARIABLE DISPLACEMENT WOBBLE PLATE TYPE COMPRESSOR WITH A SOLENOID OPERATED WOBBLE ANGLE CONTROL UNIT

[75] Inventors: Toshiro Fujii; Shinichi Suzuki; Akira Nakamoto, all of Kariya, Japan

[73] Assignee: Kabushiki Kaisha Toyoda Jikoshokki Seisakusho, Aichi, Japan

[21] Appl. No.: 170,558

[22] Filed: Mar. 21, 1988

[30] Foreign Application Priority Data

Mar. 28, 1987 [JP] Japan ..... 62-074879

[51] Int. Cl.[4] ..... F04B 1/28; F04B 1/06

[52] U.S. Cl. ..... 417/222; 417/270

[58] Field of Search ..... 417/222 S, 222, 270; 92/12.2

[56] References Cited

U.S. PATENT DOCUMENTS

| | | | |
|---|---|---|---|
| 4,145,163 | 3/1979 | Fogelberg et al. . | |
| 4,428,718 | 1/1984 | Skinner . | |
| 4,526,516 | 2/1985 | Swain | 417/270 |
| 4,727,754 | 5/1988 | Fujii et al. | 417/222 S |

*Primary Examiner*—William L. Freeh

*Attorney, Agent, or Firm*—Burgess, Ryan & Wayne

[57] ABSTRACT

A variable wobble plate type compressor with a variable angle non-rotary wobble plate, having a suction chamber for a refrigerant before compression, a discharge chamber for a compressed refrigerant, compressing cylinder bores, pistons reciprocated by the wobble plate within the cylinder bores for compressing the refrigerant, a crankcase having a chamber to receive therein a drive and a wobble plate mechanism connected to the pistons to cause the reciprocating motion of the pistons and capable of changing the wobble angle thereof, a first passageway closably opened so as to apply a high discharge gas pressure of the discharge chamber to the drive and wobble plate mechanism within the crankcase chamber, a solenoid-operated plunger valve for controlling an introduction of a high pressure refrigerant gas from the discharge chamber into a high pressure chamber arranged in a part of the first passageway in response to a change in a cooling load, and a second passageway providing a fluid communication between the crankcase chamber and the suction chamber, a spool valve urged by a spring toward a first position opening the second passageway to thereby permit evacuation of a high pressure gas from the crankcase chamber to the suction chamber while the solenoid-operated plunger valve stops the introduction of the high pressure refrigerant gas into the high pressure chamber of the first passageway, and moved toward a second position closing the second passageway in association with the operation of the solenoid valve for operating the first passageway and introducing the high pressure refrigerant into the high pressure chamber.

7 Claims, 4 Drawing Sheets

VARIABLE DISPLACEMENT WOBBLE PLATE TYPE COMPRESSOR WITH A SOLENOID OPERATED WOBBLE ANGLE CONTROL UNIT

BACKGROUND OF THE INVENTION

1. Field of the Invention

The present invention relates to a variable displacement wobble plate type compressor having a variable angle wobble plate mechanism within a crankcase chamber and a solenoid-operated wobble angle control unit capable of automatically changing a compressor displacement by changing the angle of inclination of the wobble plate mechanism coupled with compressor pistons in response to a change in a cooling load in an air-conditioning system in which the wobble plate type compressor is accommodated. More particularly, it relates to an improvement in the solenoid-operated wobble angle control unit for enhancing the performance of the control unit.

2. Description of the Related Art

A variable displacement wobble plate type compressor employing a solenoid-operated valve for controlling a wobble plate angularity is typically disclosed in U.S. Pat. No. 4,533,299 to Swain et al. In the compressor, the solenoid-operated valve is used for controlling the opening and closing of a passageway between a high pressure discharge chamber and a crankcase chamber in which a variable angle wobble plate mechanism to drive the reciprocating motion of compressor pistons is accommodated. When the passageway between the high pressure discharge chamber and the crankcase chamber is opened, a high pressure gas is permitted to flow from the discharge chamber into the crankcase chamber so that a rise in pressure within the crankcase chamber occurs and a small angularity of the wobble plate mechanism is achieved. On the other hand, in the disclosed compressor, the crankcase chamber is communicated with a low pressure suction chamber of the compressor by another passageway having an orifice permitting a blow-by gas leaking from compressor cylinder bores into the crankcase chamber to escape from the crankcase chamber into the suction chamber. However, due to provision of the orifice, the crankcase chamber is always communicated with the low pressure suction chamber, and as a result, at the initial stage of the opening of the passageway between the high pressure discharge chamber and the crankcase chamber, a high pressure gas flowing from the discharge chamber to the crankcase chamber is able to escape from the crankcase chamber toward the suction chamber, and accordingly, the high pressure gas is unable achieve the desired function of contributing to a smooth and quick rise in the crankcase chamber pressure.

U.S. Pat. No. 4,586,874 to Hiraga et al discloses another variable displacement wobble plate type compressor employing a solenoid-operated valve mechanism for controlling the wobble plate angularity. The solenoid-operated valve mechanism of U.S. Pat. No. 4,586,874 is arranged so as to be capable of opening and closing a passageway between a crankcase chamber and a suction chamber of the compressor. That is, when the passageway is opened by the solenoid-operated valve mechanism, a decrease in pressure within the crankcase chamber occurs so that the angularity of the wobble plate can be increased. However, in the solenoid-operated valve mechanism for controlling the wobble plate angularity of U.S. Pat. No. 4,586,874, an increase in pressure of the crankcase chamber for reducing the wobble plate angularity must rely on a blow-by gas leaking from compressor cylinders into the crankcase chamber during the closing of the solenoid-operated valve plate. Accordingly, in the compressor of U.S. Pat. No. 4,586,874, a high discharge pressure gas is not used for increasing the crankcase chamber pressure and thus it is difficult to realize a smooth and quick change in the wobble plate angularity in response to a change in a cooling load.

U.S. Pat. No. 4,702,677 to Takenaka et al discloses a further variable displacement wobble plate type compressor with a wobble angle return system for promoting a quick return of the wobble plate from the least wobble angle position to a larger wobble angle position. The wobble angle return system employs first and second mechanically operated valves, the first valve being used for controlling fluid communication between a crankcase chamber and a discharge chamber of the compressor, and the second value being used for controlling an extent of fluid communication between the crankcase chamber and a suction chamber of the compressor. However, the wobble angle return system of U.S. Pat. No. 4,702,677 does not teach a complete association of the operation of the first and second valves. Moreover, the system is silent about the employment of a solenoid-operated valve means. Thus, the wobble angle return system of U.S. Pat. No. 4,702,677 has a limitation in the rapidity of a change in the wobble plate angularity.

SUMMARY OF THE INVENTION

An object of the present invention is, therefore, to provide a variable displacement wobble plate type compressor with a wobble angle control unit enabling a smooth and quick change in wobble plate angularity in response to a change in a cooling load.

Another object of the present invention is to provide a solenoid-operated wobble angle control unit for a variable displacement wobble plate type compressor which is capable of achieving a rapid rise in a pressure within a crankcase chamber for rapidly changing from a large displacement operation to a small displacement operation depending on lowering of a cooling load of the compressor.

A further object of the present invention is to provide a solenoid-operated type wobble angle control unit for a variable displacement wobble plate type compressor, which is provided with a solenoid-operated plunger valve and a change-over spool valve capable of quickly responding to the operation of the solenoid-operated plunger valve.

In accordance with the present invention, there is provided a variable displacement wobble plate type compressor for an air-conditioning system, which includes a housing element having therein a suction chamber for a refrigerant to be compressed and a discharge chamber for a compressed refrigerant, a cylinder block defining therein a plurality of cylinder bores in which associated reciprocatory pistons are disposed so as to draw the refrigerant from the suction chamber and then to discharge the refrigerant after compression to the discharge chamber, a closed crankcase defining therein a chamber for an assembly of wobble and drive plates to drive the reciprocatory pistons, and a control unit for changing an angle of wobble of the wobble plate in association with a change in a cooling load of the air-conditioning system, to thereby change a compressor.

displacement. The control unit comprises: first passageway means for fluidly communicating the chamber of the crankcase with the discharge chamber of the housing element; first chamber means arranged in the first passageway means for defining a high pressure receiving chamber capable of being supplied with a pressure of the compressed refrigerant; solenoid valve means arranged in the first passageway means for controlling the communication between the high pressure receiving chamber and the discharge chamber in response to the change in the cooling load, the solenoid valve means including a solenoid element capable of being energized and de-energized in response to a signal indicating the change in the cooling load and a movable plunger element magnetically moved by the solenoid between a first position thereof communicating between the discharge chamber and the high pressure receiving chamber and a second position thereof disconnecting between the discharge chamber and the high pressure receiving chamber; second passageway means for fluidly communicating the chamber of the crankcase with the suction chamber of the housing element; second chamber means arranged in the second passageway means for defining a low pressure receiving chamber capable of being supplied with a pressure of the refrigerant from the suction chamber; spring-biased spool valve means for commonly controlling a fluid communication of both first and second passageway means in cooperation with the solenoid valve means, the spring-biased spool valve means including a valve body element defining therein a spool chamber extending between the high pressure receiving chamber of the first passageway means and the low pressure receipt chamber of the second passageway_means, a spool element slidably received in the spool chamber and movable between a first position thereof to realize a fluid connection between the chamber of the crankcase and the suction chamber and a fluid disconnection between the chamber of the crankcase and the discharge chamber, and a second position thereof to realize a fluid connection between the chamber of the crankcase and the discharge chamber and a fluid disconnection between the chamber of the crankcase and the suction chamber, and a first spring element received in the low pressure receiving chamber for biasing the spool element toward the first position against the pressure in the high pressure receiving chamber, and means for associating movement of the spool element of the spring-biased spool valve means with movement of the plunger element of the solenoid valve means.

BRIEF DESCRIPTION OF THE DRAWINGS

Other objects, features and advantages of the present invention will be made more apparent from the ensuing description of the embodiment of the present invention with reference to the accompanying drawings, wherein.

DESCRIPTION OF THE PREFERRED EMBODIMENT

The following description is provided for the case where the present invention is embodied by a variable displacement compressor with a solenoid-operated wobble angle control unit used for air-conditioning a vehicle compartment or a car compartment. Therefore, the compressor is driven by a car engine via an appropriate rotation transmitting mechanism, such as a conventional belt-pulley mechanism.

Figure 1:
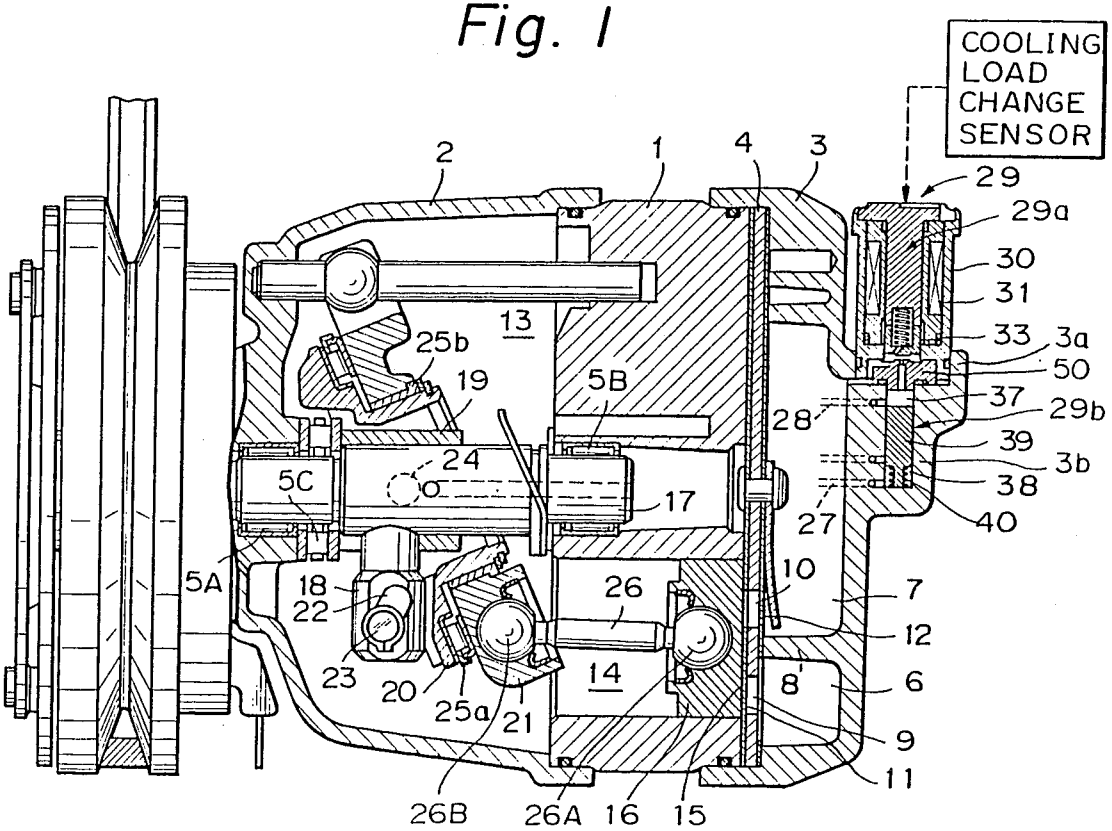
FIG. 1 is a vertical cross-sectional view of a variable displacement wobble plate type compressor with a solenoid-operated wobble angle control unit according to an embodiment of the present invention.
Figure 4:
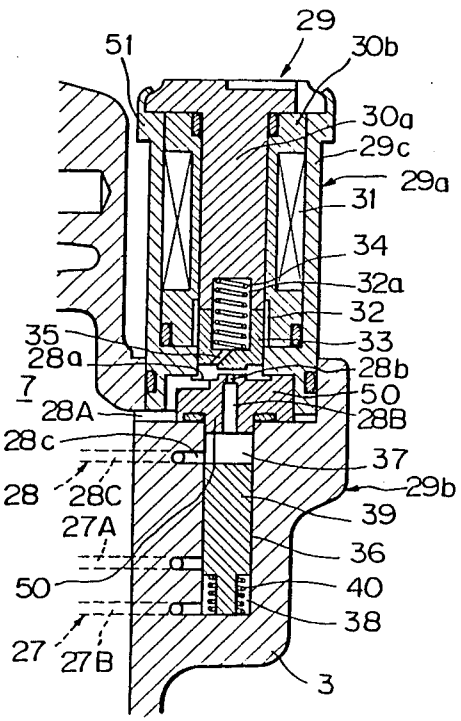
FIG. 4 is also a similar view to FIG. 2, illustrating a state where the solenoid-operated plunger valve is at an open position and the spool valve is completely changed over.
Figure 3:
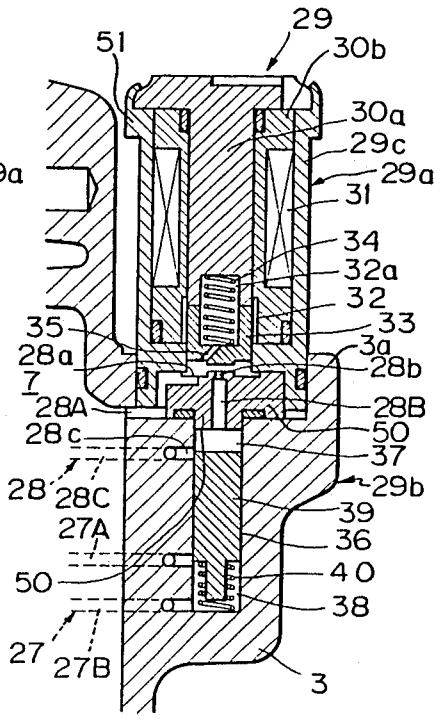
FIG. 3 is a similar view to FIG. 2, illustrating a state where a spool valve starts to move for a change-over operation after opening of the solenoid operated plunger valve.

Referring to FIGS. 1 through 4, a variable displacement wobble plate type compressor having a variable compression displacement includes a cylinder block 1, usually cylindrical in shape, having opposite open ends. One end of the cylinder block 1, i.e., the right open end in FIG. 1, is closed via a valve plate 4, by a rear housing or a head 3 having therein an outer suction chamber 6 annularly extending in the head 3 and an inner discharge chamber 7 separated from the outer suction chamber 6 by an annular partition wall 8. The other open end of the cylinder block 1, i.e., the left open end in FIG. 1, is closed by a front housing or crankcase 2 having therein a chamber 13 for receiving an assembly of a wobble plate mechanism described later. The crankcase 2 also has a centrally arranged bearing bore in which a rotary radial bearing 5A for rotatably supporting a drive shaft 17 is received. Further, a rotary thrust bearing 5C mounted on the drive shaft 17 for assuming a thrust load is arranged adjacent to the rotary radial bearing 5A. Another rotary radial bearing 5B supporting the drive shaft 17 is received in a central portion of the cylinder block 1 coaxially with relation to the rotary radial bearing 5A. The suction chamber 6 of the rear housing 3 is communicated via suction ports 9 formed in the valve plate 4 with later-described compression chambers 15 of cylinder bores 14 of the cylinder block 1. The suction ports 9 of the valve plate 4 are opened and closed by suction valves 11, which open during the suction strokes of later-described pistons 16 and close during the compression strokes of the pistons 16.

The discharge chamber 7 of the rear housing 3 is communicated with the compression chambers 15 of the cylinder bores 14 via discharge ports 10 also formed in the valve plate 4 and provided with discharge valves 12 which open during the compression strokes of the pistons 16 and close during the suction strokes of the pistons 16.

The cylinder block 1 is formed with a plurality of axial cylinder bores 14 which are arranged in parallel with the drive shaft 17 and equiangularly spaced apart from one another on a circle about the axis of the drive shaft 17. The axial cylinder bores 14 are all communicated with the chamber 13 of the crankcase 2. Each of the cylinder bores 14 is slidably fitted with a reciprocatory piston 16 which has a compressing face opposed to the valve plate 4, i.e., the right end face, defining the above-mentioned compression chamber 15 within the associated cylinder bore 14 so as to be communicatable alternately with the suction and discharge chambers 6 and 7. The piston 16 also has a rear face opposed to the crankcase chamber 13, i.e., the left end face, to which an end of a connecting rod 26 is connected via a ball and socket joint 26A to a later-described wobble plate 21.

Within the crankcase chamber 13, the drive shaft 17 horizontally extends between the rotary radial bearings 5A and 5B, with a support pin 18 projecting radially from the drive shaft 17 and rotating with the drive shaft 17. On the support pin 18, a drive plate 20 in the form of an annular element surrounding the drive shaft 17 is supported so as to be rotatable with the drive shaft 17 and capable of wobbling about an axis perpendicular to the rotating axis of the drive shaft 17, i.e., toward and away from a plane vertical to the drive shaft 17. That is, the support pin 18 is formed with a curved guide slot 22 having a center of curvature selected so as to correspond to a center of each of the ball and socket joints 26B every time the support pin 18 comes into registration with one of the plurality of the cylinder bores 14. On the other hand, the drive plate 20 is provided with a guide pin 23 projecting into and engaging the curved guide slot 22. Thus, when the drive shaft 17 is rotated by a vehicle engine, the drive plate 20 is rotated together with the drive shaft 17 via the engagement of the support pin 18 and the guide pin 23. Also, the drive plate 20 is made to wobble by the sliding of the guide pin 23 in the curved guide slot 22 under the guidance of the curved wall of the slot 22. Mounted on the drive shaft is a slidable sleeve element 19 connected to the drive plate 20 via a pair of laterally extending connecting pins 24. Thus, the sleeve element 19 axially slides along the drive shaft 17 in association with the wobble motion of the drive plate 20. The wobble plate 21, described previously, is non-rotatably supported on the drive plate 20 by means of a rotary thrust bearing **25*a* and a radial bearing 25*b* and is wobbled together with the drive plate 20. The wobble plate 21 in the form of an annular element surrounding a journal portion of the drive plate 20 and the drive shaft 17 is connected to each of the pistons 16 by the associated connecting rod 26 described before. The above-described drive shaft 17, the support pin 18, the drive plate 20, the wobble plate 21, and the connecting rods 26 constitute an assembly of a wobble plate mechanism for causing the reciprocatory movement of the pistons 16 in the cylinder bores 14**.

A fluid passageway 27 extends from the suction chamber 6 of the rear housing or head 3 to the crankcase chamber 13 so as to provide a fluid communication between these two chambers 6 and 13.

Another fluid passageway 28 extends from the discharge chamber 7 of the rear housing 3 to the crankcase chamber 13 so as to provide a fluid communication between these discharge and crankcase chambers 7 and 13.

In the above-described fluid passageways 27 and 28 is arranged a control valve unit 29 to control the respective fluid communications between the crankcase chamber 13 and the suction and discharge chambers 6 and 7, to thereby control a pressure condition within the crankcase chamber 13. The control valve unit 29 is mounted in the rear housing 3 and has two different valves, one being a solenoid-operated plunger valve **29*a* for controlling the opening and closing of a part of the passageway 28 and the other being a spring-biased spool valve 29*b* for carrying out the change-over of the passageway 27 from an opened to closed condition and vice versa as well as the change-over of the passageway 28 from a closed to opened condition and vice versa. As described later, the spring-biased spool valve 29*b* is operated in association with the operation of the solenoid-operated plunger valve 29*a*. The solenoid-operated plunger valve 29*a* of the control valve unit 29 is mounted in a mount 3*a* of the rear housing 3 and the spring-biased spool valve 29*b* is accommodated in a spool valve receipt portion 3*b* formed in a part of the rear housing 3**.

The solenoid-operated plunger valve **29*a* includes a cylindrical valve housing 29*c* sealingly mounted in the mount 3*a* of the rear housing 3, a fixed core 30*a* having a lower recessed end formed as a spring chamber 32*a*, a hollow cylindrical bobbin 30*b* having a lower recessed end formed as a plunger chamber 32, an axially movable plunger 33 arranged in the plunger chamber 32*a*, a fixed valve seat element 50 having a small port 28*b* and a short passageway portion 28*b* of the passageway 28, a biasing spring 34 positioned in the spring chamber 32*a* for biasing the plunger 33 in the direction away from the lower end of the fixed core 30*a* toward an upper end of the valve seat element 50, and a solenoid 31 arranged around the bobbin 30*b*. The solenoid 31 is energized or de-energized in response to a signal indicating a change in a cooling load from a low load condition to a large load condition and vice versa with regard to a predetermined cooling load condition, and when energized, electro-magnetically attracts the plunger 33 toward the lower end of the fixed core 30*a* from the upper end of the valve seat element 50 against a spring force of the spring 34. That is, the plunger 33 is arranged so as to connect or disconnect a fluid communication between a fluid passageway portion 28A and the above-mentioned short passageway portion 28B of the valve seat 50. The fluid passageway portion 28A directly opening toward the discharge chamber 7 of the rear housing 3 is communicatable with the short passageway portion 28B via a port 28*a* formed between the valve seat 50 and the lower end of the valve housing 29*c*. The short passageway portion 28B directly opens toward a high pressure receiving chamber 37 which is communicatable with the crankcase chamber 13 by way of a port 28*c* and a fluid passageway portion 28C of the passageway 28. The passageway portion 28A is always communicated with the spring chamber 32*a* of the core element 30*a* via a small aperture 35 formed in the plunger 33 so that a pressure of the refrigerant gas in the discharge chamber 7 is constantly introduced in the spring chamber 32*a***.

Figure 2:
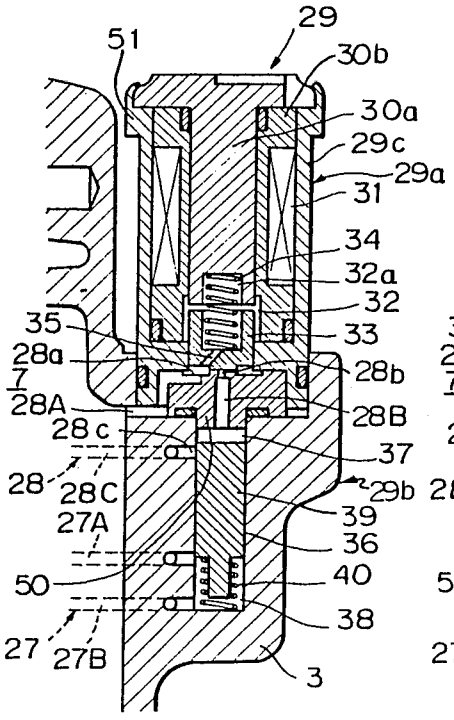
FIG. 2 is an enlarged cross-sectional view of the solenoid-operated wobble angle control unit accommodated in the compressor of FIG. 1 and illustrates a state where the solenoid-operated plunger valve is at a closed position.
Figure 5:
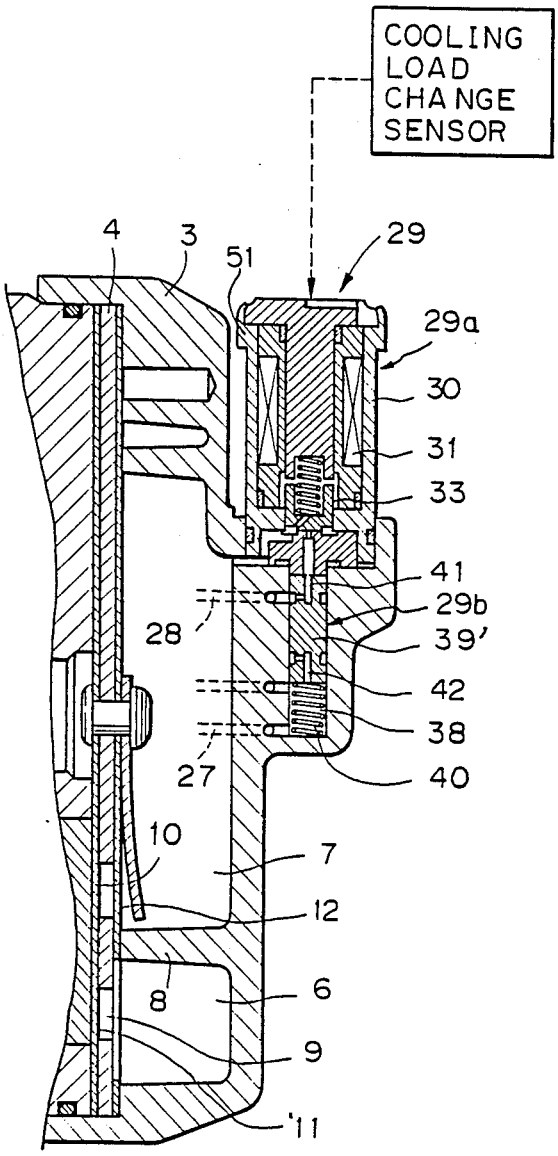
FIG. 5 is a partial vertical cross-sectional view of a variable displacement wobble plate type compressor with a solenoid-operated wobble angle control unit according to a different embodiment of the present invention.

The spool valve receiving portion **3*b* of the rear housing 3 has a cylindrical bore formed as a cylindrical spool chamber 36 which extends between the fluid passageways 27 and 28**. That is, one end of the spool chamber 36 is communicated with the afore-mentioned high pressure receiving chamber 37 and the other end of the spool chamber 36 is communicated with a lower pressure receiving chamber 38 formed in a part of the fluid passageway 27. The lower pressure receiving chamber 38 has an upper port opening toward the suction chamber 6 via a passageway portion 27A of the fluid passageway 27 and a lower port opening toward the crankcase chamber 13 via a passageway portion 27B of the fluid passageway 27. Within the spool chamber 36 is provided a slidable spool element 39 of the spring-biased spool valve 29*b* of the control valve unit 29. One end portion of the spool element 39 opens and closes the port 28*c* of the fluid passageway 28 and the other end portion thereof opens and closes the upper port of the lower pressure receipt chamber 38. The spool element 39 also has a smaller diameter portion thereof on the side of the lower pressure receiving chamber 38, and a spring 40 received in the lower pressure receiving chamber 38 is disposed around the smaller diameter portion of the spool element 39. The spring 40 is arranged so as to always urge the spool element 39 toward a position where it closes the port 28*c* of the high pressure receiving chamber 37, to thereby interrupt the fluid communication between the crankcase chamber 13 and the discharge chamber 7, and opens the upper port of the lower pressure receiving chamber 38 to thereby establish a fluid communication between the crankcase chamber 13 and the suction chamber 6 as illustrated in FIG. 2. When a high pressure of the compressed refrigerant gas is introduced into the high pressure receiving chamber 37 from the discharge chamber 7 due to energization of the solenoid-operated plunger valve 29*a*, the spool element 39 of the spring-biased spool valve 29*b* is moved toward the lower pressure receiving chamber 38, via a position of FIG. 3, against the spring force of the spring 40 so that it changes over the fluid communication between the crankcase chamber 13 and the suction chamber 6 to that between the crankcase chamber 13 and the discharge chamber illustrated in FIG. 4.

From the foregoing description of the construction of the control valve 29, it will be understood that the spool valve 29*b* operates in association with the solenoid-operated plunger valve 29*a*.

FIGS. 5 through 8 illustrate a variable displacement wobble plate type compressor with a displacement control unit according to a different embodiment of the present invention. It should be understood that the same reference numerals designate the same elements as those of the compressor of FIGS. 1 through 4.

The most important difference of the present embodiment from the former embodiment is in the construction and operation of the spring-biased spool valve 29*b* of the control valve unit 29.

The spring-biased spool valve 29*b* has a spool element 39′ in the shape of a long rod slidable in the spool chamber 36. The spool element 39′ has one end confronting the high pressure receiving chamber 37 of the fluid passageway 27 and provided with a subsidiary narrow fluid passageway 41. The subsidiary narrow fluid passageway 41 is provided for allowing the compressed refrigerant to escape from the high pressure receiving chamber 37 and the short passageway 28B toward the crankcase chamber 13 when the spool element 39′ is moved to an upper position where it blocks the fluid passageway 28, as best illustrated i FIG. 6.

The other end of the spool element 39′ confronts the lower pressure receiving chamber 38 of the fluid passageway 27 and is provided with a different subsidiary narrow fluid passageway 42. The subsidiary narrow fluid passageway 42 is provided to allow a part of the compressed refrigerant to escape from the crankcase chamber 13 toward the suction chamber 6 via the passageway 27A, the lower pressure receiving chamber 38, and the passageway 27B when the spool element 39′ is moved to a lower position where it blocks the fluid passageway 27, as best illustrated in FIG. 8.

Figures 6, 7, 8:
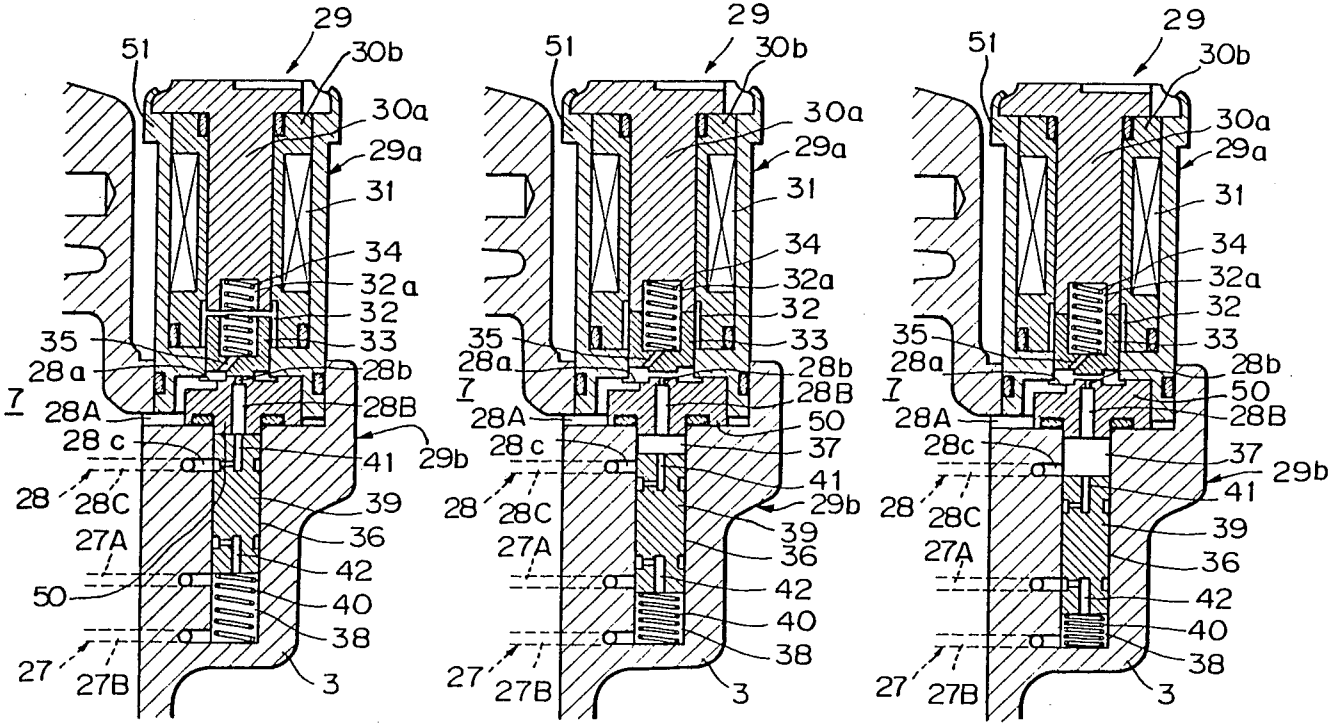
FIG. 6 is an enlarged cross-sectional view of the solenoid-operated wobble angle control unit accommodated in the compressor of FIG. 5 and illustrates a state where the solenoid-operated plunger valve is at a closed position.
FIG. 7 is a similar view of FIG. 6, illustrating a state where a spool valve starts to move for a change-over operation after opening of the solenoid operated plunger valve.
FIG. 8 is also a similar view to FIG. 6, illustrating a state where the solenoid-operated plunger valve is at an open position and the spool valve is completely changed over.

FIG. 7 illustrates an intermediate position of the spool element 39′ between the positions of FIGS. 6 and 8. In the intermediate position of FIG. 7, the spool element 39′ simultaneously blocks both of the fluid passageways 27 and 28. It should be noted that, when the pressure of the compressed refrigerant within the crankcase chamber 13 is decreased during the small displacement operation of the compressor, the spring 40 arranged in the low pressure receiving chamber 38 exerts an adjusted spring force by which the spool element 39′ can be stopped at the intermediate position. Therefore, a decrease of the pressure level within the crankcase chamber 13 can be prevented and the pressure can be maintained at a fixed level. As a result, the angularity of the wobble plate 21 is maintained at a fixed erect position having a small inclination with respect to a vertical position.

The operation of the variable displacement wobble plate type compressor according to the above-described two embodiments of the present invention will be described hereunder.

Referring again to FIGS. 1 through 4, when the cooling load in the car compartment to be air-conditioned by the variable displacement wobble plate type compressor of the present embodiment is larger than a predetermined value, the solenoid 31 of the solenoid-operated plunger valve 29*a* of the control valve unit 29 is de-energized, and thus the port 28*b* of the fluid passageway 28 is closed by the plunger 33 (FIG. 2). That is, the fluid communication between the discharge chamber 7 and the crankcase chamber 13 is blocked. Therefore, a supply of a high pressure refrigerant gas from the crankcase chamber 13 to the high pressure receiving chamber 37 is stopped. Therefore, the spool 39 of the spring-biased spool valve 29*b* is urged by the spring 40 toward the high pressure receiving chamber 37 and closes the fluid passageway 28 while opening the fluid passageway 27, i.e., only the fluid communication between the crankcase chamber 13 and the suction chamber 6 is established. Thus, the pressure level within the crankcase chamber 13 is maintained at a pressure equivalent to that of the suction chamber 6. That is, a blow-by gas leaking from the compression chambers 15 of the cylinder bores 14 into the crankcase chamber 13 is evacuated from the chamber 13 toward the suction chamber 6 via the open fluid passageway 27. While the pressure level within the crankcase chamber 13 is maintained at a level substantially equal to that of the suction chamber 6, the pistons 16 are permitted to reciprocate within the cylinder bores 14 so that they move toward their bottom dead centers, respectively, during the suction strokes. That is, the drive and wobble plates 20 and 21 are wobbled by a large angularity with respect to a plane perpendicular to the axis of the drive shaft 17. This ensures that a large amount of piston stroke can be obtained on each piston 16, and therefore, a maximum compression displacement is acquired. While the compressor is operated with the large displacement, the air-conditioning system continues to cool the car compartment, and thus the cooling load is gradually decreased until it approaches the predetermined cooling load value.

When the cooling load value within the car compartment is less than the predetermined cooling load value, a signal is applied to the solenoid-operated plunger valve 29a, which indicates that the solenoid 31 is to be energized. When the solenoid 31 is energized, the plunger 33 is electro-magnetically attracted toward the end of the fixed core 30a of the solenoid-operated plunger valve 29a and opens the port 28b of the valve seat 50 arranged in the fluid passageway 28. Therefore, a high pressure refrigerant gas is supplied from the discharge chamber 7 to the high pressure receiving chamber 37 and causes a rapid movement of the spool 39 away from the high pressure receiving chamber 37 toward the lower pressure receiving chamber 38. That is, the spool 39 is moved from the position of FIG. 2 to that of FIG. 4 via the position of FIG. 3, while overcoming the spring force of the spring 40. As a result, the crankcase chamber 13 is fluidly communicated with the discharge chamber 7 via the fluid passageway 28, and the open ports 28a, 28b, and 28c. Simultaneously, the fluid communication of the crankcase chamber 13 with the suction chamber 6 is blocked due to the closing of the fluid passageway 27 by the spool element 39. Thus, a high pressure refrigerant gas is sent from the discharge chamber 7 into the crankcase chamber 13 to thereby cause a rapid pressure rise within the crankcase chamber 13. At this stage, it should be understood that the disconnection of the fluid passageway 27 occurs at substantially the same time as the opening of the fluid passageway 28, due to the quick operation of the spring-biased spool valve 29b in association with the operation of the solenoid-operated plunger valve 29a which introduces a high pressure refrigerant gas into the high pressure receiving chamber 37 via the short passageway 28B of the valve seat 50. Therefore, no leakage of gas from the crankcase chamber 13 toward the suction chamber 6 occurs, and accordingly, the pressure level within the crankcase chamber 13 is rapidly increased by the supply of the high pressure discharge gas from the discharge chamber 7. Therefore, when the pistons 16 carry out their suction strokes, the end face of each piston 16 opposed to the compression face thereof is subjected to a high pressure which is sufficiently higher than the suction pressure of the refrigerant, and thus, during the suction stroke of the respective pistons 16, the pistons 16 are prevented from being moved to their bottom dead centers, respectively. Consequently, the angle of the wobble of the drive and wobble plates 20 and 21 is limited to a smaller angle, and therefore, the stroke of the pistons 16 is decreased with a resulting reduction in the compression displacement of the compressor.

While the compressor is carrying out the small displacement operation, when the cooling load within the car compartment increases until it reaches the predetermined cooling load value, a signal is applied to the solenoid-operated valve 29a of the control valve unit 29, so that the solenoid 31 is de-energized. As a result, the plunger 33 is moved back to the valve seat element 50 so as to close the fluid passageway 28, and thus the fluid communication between the crankcase chamber 13 and the discharge chamber 7 is interrupted. As soon as the fluid passageway 28 is closed, the supply of the high pressure discharge gas from the discharge chamber 7 into the crankcase chamber 13 and the high pressure receiving chamber 37 of the solenoid-operated valve 29a is stopped. Accordingly, the spool 39 of the spool valve 29b is immediately moved up by the spring 40 toward the high pressure receiving chamber 37, so that the fluid passageway 27 is opened. Consequently, the pressure level within the crankcase chamber 13 decreases until it becomes substantially equal to the suction pressure level, and thus a large displacement operation of the compressor is obtained.

The similar operation of the control valve unit 29 is carried out by the second embodiment of FIGS. 5 through 8. However, when the spool element 39' of the spring-biased spool valve 29b is moved into the low pressure receiving chamber 38 illustrated in FIG. 8, to establish a fluid communication between the crankcase chamber 13 and the discharge chamber 7 via the fluid passageway 28 as well as to block a fluid communication between the crankcase chamber 13 and the suction chamber 6 via the fluid passageway 27, the subsidiary narrow fluid passageway 42 in the spool element 39' is able to maintain a limited fluid communication between the crankcase 13 and the suction chamber 7. Therefore, a part of a high pressure refrigerant gas supplied from the discharge chamber 7 to the crankcase chamber 13 by the open fluid passageway 28 can escape from the crankcase chamber 13 toward the suction chamber 6 through the subsidiary narrow fluid passageway 42. As a result, while the compressor is carrying out the low displacement operation, a pressure level within the crankcase chamber 13 can be prevented from rising to an excessive level, and accordingly, it is ensured that a supply of a high pressure refrigerant gas to the crankcase chamber 13 does not exceed the amount necessary for varying the angularity of the wobble plate 21 from a large inclination angle thereof (a large displacement operation) to a small inclination angle thereof (a small displacement operation).

When the spool element 39' of the spring-biased spool valve 29b is moved into the high pressure receiving chamber 37 illustrated in FIG. 6, to establish a fluid communication between the crankcase chamber 13 and the suction chamber 6 via the fluid passageway 27 as well as to block a fluid communication between the crankcase chamber 13 and the discharge chamber 7 via the fluid passageway 28, the subsidiary narrow fluid passageway 41 in the spool element 39' allows a high pressure refrigerant gas within the high pressure receiving chamber 38 and the short passageway 28B of the valve seat 50 to escape toward the crankcase chamber 13. That is, a confinement of the high pressure refrigerant gas within the high pressure receiving chamber 37 is prevented during the process of a change-over of the fluid communication by the passageway 28 to that by the passageway 27. Therefore, when the small displacement operation of the compressor with a small wobble angularity of the wobble plate 21 is switched to the large displacement operation thereof with a large wobble angularity of the wobble plate 21, the spool element 39' of the spring-biased spool valve 29b can be smoothly moved from the low pressure receiving chamber 38 toward the high pressure receiving chamber 37 without resistance by the confined high pressure gas.

Further, while the compressor is carrying out the low displacement operation under a supply of a high pressure refrigerant gas from the discharge chamber 7 to the crankcase chamber 13 by the fluid passageway 28, when the pressure level of the discharged refrigerant gas per se is decreased, to reduce a pressure difference between a pressure of the suction gas and that of the discharged gas, the spring 40 in the low pressure receiving chamber 38 exerts a spring force adjusted to counterbalance the pressure difference and to move the spool element 39' to a position where both fluid passageways 27 and 28 are blocked by the spool element 39' (FIG. 7). As a result, the pressure level within the crankcase chamber 13 is sufficient to maintain the angularity of the wobble plate 21 at a position where a minimum displacement operation of the compressor is continuously carried out. This ensures that a change in the wobble plate angularity from the minimum displacement operation condition to a large displacement operation condition starts immediately in accordance with a cooling load change signal commanding a large displacement operation, without any loss of time.

From the foregoing description of the embodiments of the present invention, it will be understood that, according to the present invention, due to the provision of the solenoid-operated wobble angle control unit having a solenoid-operated plunger valve and the spring-biased spool valve operated in association with the plunger valve, the pressure level within the crankcase chamber of a variable displacement wobble plate type compressor can be quickly and smoothly increased or decreased in response to a change in a cooling load of the compressor. Therefore, the compressor displacement can be smoothly and quickly varied in response to the change in the cooling load. Moreover, the known duty control of the solenoid-operated plunger valve is simplified.

Also, according to the present invention, the spring-biased spool valve is able to accomplish a rapid and smooth change over of the operation condition from a fluid communication between the crankcase chamber and the discharge chamber to a fluid communication between the crankcase chamber and the suction chamber and vice versa, due to provision of a high pressure receiving chamber and a low pressure receiving chamber on the opposite ends of the spool element. Thus, the switching of a small displacement operation of a variable displacement wobble plate type compressor to a large displacement operation of the compressor, and vice versa, is rapidly and smoothly carried out.

We claim:

1. A variable displacement wobble plate type compressor for an air-conditioning system including a housing element having therein a suction chamber for a refrigerant to be compressed and a discharge chamber for a compressed refrigerant, a cylinder block defining therein a plurality of cylinder bores in which associated reciprocatory pistons are disposed so as to draw the refrigerant from the suction chamber and then discharge the refrigerant after compression to the discharge chamber, a closed crankcase defining therein a chamber for an assembly of wobble and drive plates to drive the reciprocatory pistons, and a control means for changing an angle of wobble of the wobble plate in association with a change in a cooling load of the air-conditioning system, to thereby change a compressor displacement, wherein said control means comprises:

first passageway means for fluidly communicating said chamber of said crankcase with said discharge chamber of said housing element;

first chamber means arranged in said first passageway means for defining a high pressure receiving chamber capable of being supplied with a pressure of said compressed refrigerant;

solenoid valve means arranged in said first passageway means for controlling the communication between said high pressure receiving chamber and said discharge chamber in response to the change in the cooling load, said solenoid valve means including a solenoid element capable of being energized and deenergized in response to a signal indicating the change in the cooling load and a movable plunger element magnetically moved by said solenoid element between a first position thereof whereat communication is established between said discharge chamber and said high pressure receiving chamber and a second position thereof disconnecting said communication between said discharge chamber and said high pressure receiving chamber;

second passageway means for fluidly communicating said chamber of said crankcase with said suction chamber of said housing element;

second chamber means arranged in said second passageway means for defining a low pressure receiving chamber capable of being supplied with a pressure of said refrigerant from said suction chamber;

spring-biased spool valve means for commonly controlling a fluid communication of both said first and second passageway means in cooperation with said solenoid valve means, said spring-biased spool valve means including a valve body element defining therein a spool chamber extending between said high pressure receiving chamber of said first passageway means and said low pressure receiving chamber of said second passageway means, a spool element slidably received in said spool chamber and movable between a first position thereof creating a fluid connection between said chamber of said crankcase and said suction chamber while disconnecting a fluid connection between said chamber of said crankcase and said discharge chamber and a second position thereof creating a fluid connection between said chamber of said crankcase and said discharge chamber while disconnecting a fluid connection between said chamber of said crankcase and said suction chamber, and a first spring element received in said low pressure receiving chamber for biasing said spool element toward said first position against said pressure in said high pressure receiving chamber; and means for associating a movement of said spool element of said spring-biased spool valve means with a movement of said plunger element of said solenoid valve means.

2. A variable displacement wobble plate type compressor according to claim 1, wherein said first spring element comprises a coil spring capable of exerting a spring force adjusted so as to move said spool element from said second position thereof to said first position when said solenoid element of said solenoid valve means is de-energized.

3. A variable displacement wobble plate type compressor according to claim 1, wherein said solenoid valve means comprises a stationary electro-magnetic core element having one end facing said plunger element which is magnetically moved toward said first position thereof in response to energization of said solenoid element, a valve seat element for defining said second position of said plunger element, and a second spring element arranged between said stationary electro-magnetic core element and said plunger element, for urging said plunger element toward said second position of said plunger element when said solenoid element is deenergized.

4. A variable displacement wobble plate type compressor according to claim 3, wherein said means for associating movement of said spool element of said spring-biased spool valve means comprises a short passage portion forming a part of said first passageway means, said short passage portion being formed in said valve seat element and applying a high pressure of said compressed refrigerant of said discharge chamber to said spool element so as to move said spool element toward said second position against said first spring element of said spring-biased spool valve means.

5. A variable displacement wobble plate type compressor according to claim 1, wherein said spool element comprises a long rod member slidably fitted in said spool chamber and having one end thereof disconnecting a fluid connection between said chamber of said crankcase and said discharge chamber when said spool element is moved to said first position thereof and the other end thereof disconnecting a fluid connection between said chamber of said crankcase and said suction chamber when said spool element is moved to said second position, said one end of said long rod member confronting said high pressure receiving chamber and said other end confronting said low pressure receiving chamber.

6. A variable displacement wobble plate type compressor according to claim 4, wherein said one end of said long rod member of said spool element has a first subsidiary fluid passageway for promoting a high pressure refrigerant to escape from said high pressure receiving chamber toward said crankcase when said spool element is moved to said first position thereof, and wherein said other end of said long rod member of said spool element has a second subsidiary fluid passageway for promoting an excessive high pressure refrigerant to escape from said chamber of said crankcase toward said suction chamber when said spool element is moved to said second position thereof.

7. A variable displacement wobble plate type compressor according to claim 6, wherein said first and second subsidiary fluid passageways comprise holes and grooves formed in said long rod member, respectively.

* * * * *